United States Patent [19]

Ibuki et al.

[11] Patent Number: 4,785,771

[45] Date of Patent: Nov. 22, 1988

[54] FUEL INJECTION CONTROL APPARATUS WITH FORCED FUEL INJECTION DURING ENGINE STARTUP PERIOD

[75] Inventors: Noritaka Ibuki, Oogaki; Eiji Takemoto, Oobu; Takahiro Hayakawa; Takashi Hasegawa, both of Tajimi; Masaomi Nagase, Toyota, all of Japan

[73] Assignee: Nippondenso Co., Ltd., Kariya, Japan

[21] Appl. No.: 861,577

[22] Filed: May 9, 1986

[30] Foreign Application Priority Data

May 10, 1985 [JP] Japan ..... 60-100253

[51] Int. Cl.[4] ..... F02M 39/00

[52] U.S. Cl. ..... 123/179 L; 123/494; 123/491; 123/479; 123/359; 73/119 A

[58] Field of Search ..... 123/179 L, 179 G, 357-359, 123/491, 506, 479, 449, 494; 73/119 A

[56] References Cited

U.S. PATENT DOCUMENTS

| | | | |
|---|---|---|---|
| 4,266,521 | 5/1981 | Nakano et al. | 123/179 L |
| 4,346,681 | 8/1982 | Schleicher | 123/179 L |
| 4,414,949 | 11/1983 | Honig | 123/479 |
| 4,456,831 | 6/1984 | Kanegae et al. | 123/179 L |
| 4,495,927 | 1/1985 | Yamato | 123/179 L |
| 4,522,168 | 6/1985 | Ogawa | 123/179 L |
| 4,534,328 | 8/1985 | Fischer | 123/479 |
| 4,541,386 | 9/1985 | Kishi | 123/479 |
| 4,590,566 | 5/1986 | Takahashi | 123/479 |
| 4,602,600 | 7/1986 | Aratsuka | 123/479 |
| 4,611,565 | 9/1986 | Yakuwa | 123/479 |
| 4,617,902 | 10/1986 | Hirano | 123/479 |

FOREIGN PATENT DOCUMENTS

| | | | |
|---|---|---|---|
| 58-187537 | 11/1983 | Japan | 123/506 |
| 2105067 | 3/1983 | United Kingdom | 123/179 L |
| 2130755 | 6/1984 | United Kingdom | 123/179 L |

OTHER PUBLICATIONS

Patents Abstracts of Japan, vol. 7, No. 106 (M-213)[1251], May 10th 1983; & JP-A-58 28 546 (Toyota Jidosha Kogyo K.K.) 19-02-1983.

*Primary Examiner*—Carl Stuart Miller

*Attorney, Agent, or Firm*—Cushman, Darby & Cushman

[57] ABSTRACT

Disclosed is a fuel injection control apparatus wherein the quantity of fuel supplied to an internal combustion engine is derived from engine operating parameters including a voltage signal which is generated by electromagnetic induction as a function of engine speed. A fuel injection quantity calculation circuit derives the fuel quantity in accordance with the detected operating parameters of the engine. A fuel injection controller provides injection of fuel in accordance with the calculated fuel quantity when the sensor voltage is valid and provides forced fuel injection regardless of the calculated fuel quantity when the sensor voltage is invalid and the engine starter is being operated.

3 Claims, 3 Drawing Sheets

1
2
3
4
N
S
S
N
TIME→
SENSOR VOLTAGE
M1
ENGINE
ST
M7
M6
ENGINE START DETECTOR
M5
FUEL INJECTION CONTROLLER
M11
M10
M4
CALCULATION CIRCUIT
M8
COMP.
M9
REF.
M3
ENGINE OPERATING PARAMETER SENSORS
ACCL. PDL. POSITION
COOLANT TEMP.
INTAKE PRESSURE
ENG. SPD SENSOR
M2a
ANGULAR POS. SENSOR
M2b

FUEL INJECTION CONTROL APPARATUS WITH FORCED FUEL INJECTION DURING ENGINE STARTUP PERIOD

BACKGROUND OF THE INVENTION

The present invention relates to a fuel injection control apparatus, and more specifically to a fuel injection control apparatus responsive to an output signal from an electromagnetic induction type engine speed sensor.

An electromagnetic induction type engine speed sensor is employed for electronic fuel injection systems to maximize engine operating efficiency. The amount of fuel to be supplied to engine cylinders is calculated in accordance with engine operating parameters including the engine speed parameter detected by the wheel speed sensor. More specifically, in a gasoline powered engine, the fuel injection valve is opened in response to the rotational speed signal at a predetermined crankshaft angle and is closed after a prescribed amount of time following the opening of the valve. In a Diesel engine, on the other hand, a solenoid valve is closed in response to a rotational speed signal generated at a predetermined angular position of the crankshaft to inject fuel through a delivery valve or the like and through a nozzle into the engine, and the valve is opened in response to the speed signal to terminate the fuel injection in a manner similar to that shown and described in Japanese Provisional Specification 58-187537.

Since the voltage output of the wheel speed sensor is a sinusoidal wave (as indicated by a solid line in FIG. 6) the frequency and amplitude of the voltage drops as engine speed decreases (as indicated by the broken line). If an engine starter is operated with low battery voltage or at low ambient temperatures, the engine starter would fail to supply enough power to the engine for startup, and the sensor voltage would not represent a valid speed indication. If the sensor voltage is utilized as an engine operating parameter under such conditions, fuel injection calculation would result in a failure to properly start the engine.

SUMMARY OF THE INVENTION

It is therefore an object of the invention to provide a fuel injection control apparatus having an engine start detector for disabling fuel injection calculation if the sensor voltage is insignificantly low during engine start periods by forcibly injecting fuel into the engine and ignoring the meaningless engine operating parameter.

According to the present invention, the fuel injection control apparatus comprises engine operating parameter detectors for detecting operating parameters of the engine, the operating parameter detecting means including an engine speed sensor which generates by electromagnetic induction an engine speed indicating signal. A fuel injection quantity calculation circuit derives the quantity of fuel to be injected to the engine into accordance with the detected operating parameters of the engine. An engine start detector detects whether the engine starter is being operated or not. The output of the speed sensor is compared with a threshold to detect whether it is insignificantly low or not. Fuel injection is then effected in accordance with the calculated fuel quantity when the sensor output is not lower than the threshold, and forced fuel injection is effected regardless of the calculated fuel quantity when the sensor output is insignificantly low. Simultaneously with it the operation of the engine starter is detected.

BRIEF DESCRIPTION OF THE DRAWINGS

The present invention will be described in further detail with reference to the accompanying drawings, in which.

DETAILED DESCRIPTION

Figures 1, 2, 6:
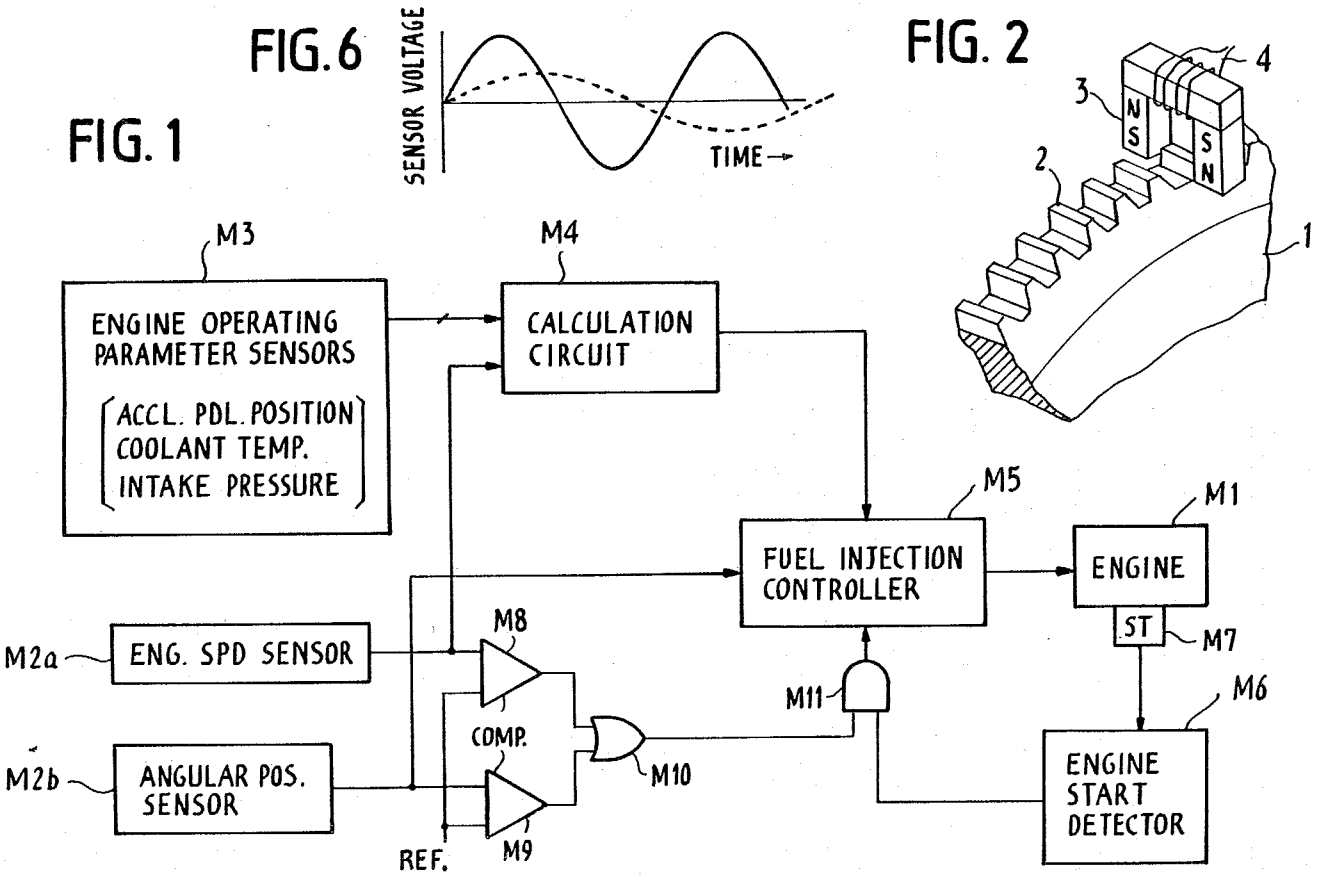
FIG. 1 is a block diagram of an embodiment of the present invention.
FIG. 2 is an explanatory view of a voltage induction type rotational speed sensor.
FIG. 6 is an illustration of waveforms generated by an electromagnetic induction type wheel speed sensor.

Referring to FIG. 1, there is schematically shown a fuel injection control apparatus of the invention. The apparatus includes engine operating parameter detectors M3 for detecting the operating parameters of an internal combustion engine M1. The engine parameter detectors include an electromagnetic induction type rotational speed sensor M2*a* which generates by electromagnetic induction a rotational speed signal having a frequency and an amplitude variable as a function of the speed of revolution of the engine, and an angular position sensor M2*b* of the electromagnetic induction type which generates a pulse at predetermined angular positions of the engine output shaft. A fuel injection quantity calculation circuit M4 is connected to the sensors M2*a* and M3 to calculate the quantity of fuel to be supplied to the engine M1 in accordance with operating parameters of the engine detected by these sensors. During a normal fuel injection control mode, the output of the calculation circuit M4 is fed to a fuel injection controller M5 to provide fuel injection in accordance with the calculated fuel quantity. Specifically, in gasoline engines the basic quantity of fuel is derived from both engine rotational speed and intake air quantity, and in the case of a Diesel engine it is derived from both engine rotational speed and the depression of the accelerator pedal. The basic fuel quantity derived in such manner is trimmed in accordance with correction factors such as engine coolant temperature and intake air temperature.

Fuel injection controller M5 is also responsive to the output of angular position sensor M2*b* during normal engine operations to effect the fuel injection at appropriate angular positions of the engine output shaft.

Speed sensor M2*a* is constructed of a magnetic disc 1 as shown in FIG. 2 which is coupled to the output shaft or distributor of the gasoline engine, or mounted on the plunger of a fuel injection pump of the Diesel engine. Magnetic disc 1 is formed with teeth 2 on the circumference thereof, each of the teeth corresponding to predetermined angular positions of the crankshaft. With the rotation of the engine the teeth 2 move past between opposite poles of a permanent magnet core 3 to cause variations of magnetic reluctance. A detection coil 4 is wound on the core to detect the reluctance variations and to generate a sinusoidal signal. Although satisfactory in terms of mechanical strength for vehicle applications, the voltage induced in the coil drops with a reduction in the speed of rotation. Therefore, if the normal fuel injection mode is effected in response to the outputs of the speed and angular position sensors of the type just described during the engine start period, sensors M2*a* and M2*b* may supply zero, or insignificantly low voltage signals so that the engine fails to start.

To avoid engine-start failure, an engine start detector M6 is provided to detect the activation of an engine starter M7. When the engine starter M7 is activated, detector M6 applies an output to a coincidence circuit, or AND gate M11. Simultaneously, the voltage outputs of sensors M2*a* and M2*b* are applied to comparators M8 and M9, respectively, for comparison with a reference voltage. When the sensor voltages are lower than the reference, each comparator applies a logical "1" output through an OR gate M10 to AND gate M11. Therefore, if either one of the sensor voltages is zero or an insignificantly low level during an engine start period, a coincidence output is supplied from AND gate M11 to fuel injection controller M5 to cause it to forcibly supply a fixed amount of fuel to the engine M1, ignoring the result of the calculation. The forced fuel injection continues until both of the sensor voltages exceed the reference level.

Figure 3:
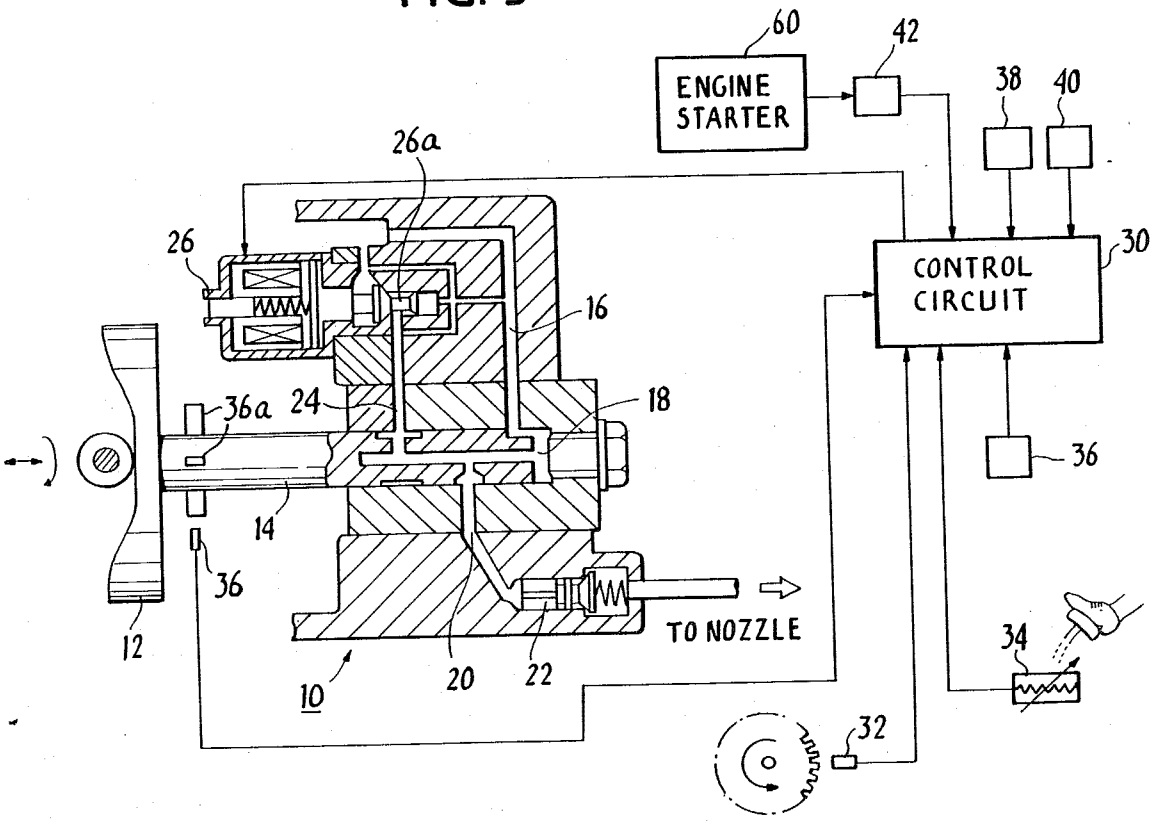
FIG. 3 is a block diagram of the fuel injection controller constructed according to the present invention.

A preferred embodiment of the invention is shown in FIG. 3. Illustrated at 10 is a fuel injection pump for a Diesel engine. Fuel pump 10 includes a plunger 14 which reciprocates in camming contact with a face cam 12 to pressurize fuel in a pressure chamber 18. Fuel is introduced into chamber 18 through an intake port 16, and fuel under pressure is delivered through a distributing port 20 and a delivery valve 22 to a fuel injection nozzle associated with a cylinder of the engine, not shown. Fuel injection pump 10 is provided with a solenoid valve 26 having a cylindrical valve member 26*a* located at one end of a spill port 24 which is in communication with pressure chamber 18. By opening the valve member 26*a* the fuel under pressure is passed, through the spill port to a lower-pressure chamber of the pump housing. As a result, the quantity of fuel to be delivered to the engine can be controlled by appropriately controlling the open time of solenoid valve 26. Solenoid valve 26 is controlled by a control circuit 30 in accordance with operating parameters of the engine.

Figure 4:
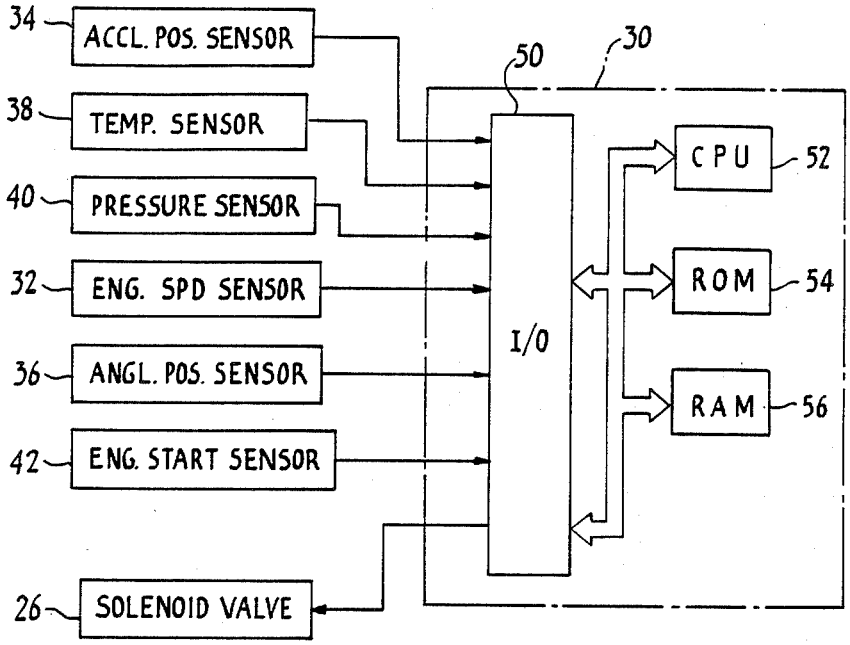
FIG. 4 is a block diagram of the control circuit of FIG. 3.

As illustrated in FIG. 4, control circuit 30 receives various input signals supplied from engine operating parameter sensors including a voltage induction type engine speed sensor 32 as mentioned previously having teeth located at a spacing of 11° or 25° crankangle, an angular position sensor 36 located in proximity to a plurality of angularly spaced apart projections 36*a* formed on the circumference of plunger 14 corresponding respectively to different engine cylinders respectively. Angular position sensor 36 generates a signal representing the angular position of the plunger 14 with respect to a reference angular position. This signal is also used to identify each cylinder. Control circuit 30 further receives signals from an acceleration position sensor 34, an engine coolant temperature sensor 38 and an intake manifold pressure sensor 40. An engine start sensor 42 is connected to an engine starter 60 to supply a signal to the control circuit 30 indicating that the engine starter is being activated. Control circuit 30 includes an input port 50 to which various input sensor signals are supplied and a central processing unit 52 which operates on the signals supplied from input/output port 50 to derive a fuel quantity according to the sensed engine operating parameters and effects on-off control on the solenoid valve 26. A read-only memory 54 stores a control program and instructions data necessary to effect the fuel injection control. A random access memory 56 temporarily stores data in the process of calculation and fuel injection control. Injection fuel quantity derived by the CPU is supplied through input/output port 50 to solenoid valve 26 in the form of a rectangular pulse.

In accordance with a feedback loop fuel injection control routine stored in ROM 54, solenoid valve 26 is closed in response to the leading edge of the rectangular pulse from control circuit 30 at a crankshaft angle determined by the outputs of engine speed sensor 32 and angular position sensor 36 to allow plunger 14 to be moved causing fuel to be delivered to a cylinder and is opened in response to the trailing edge of the pulse.

When the engine starter is activated, there is no voltage output from the angular position sensor 36 and rotational speed sensor 32. If the closed loop fuel injection control program is executed under such conditions, the solenoid valve 26 will remain in the open state and no fuel injection occurs, resulting in a failure to start the engine.

Figure 5:
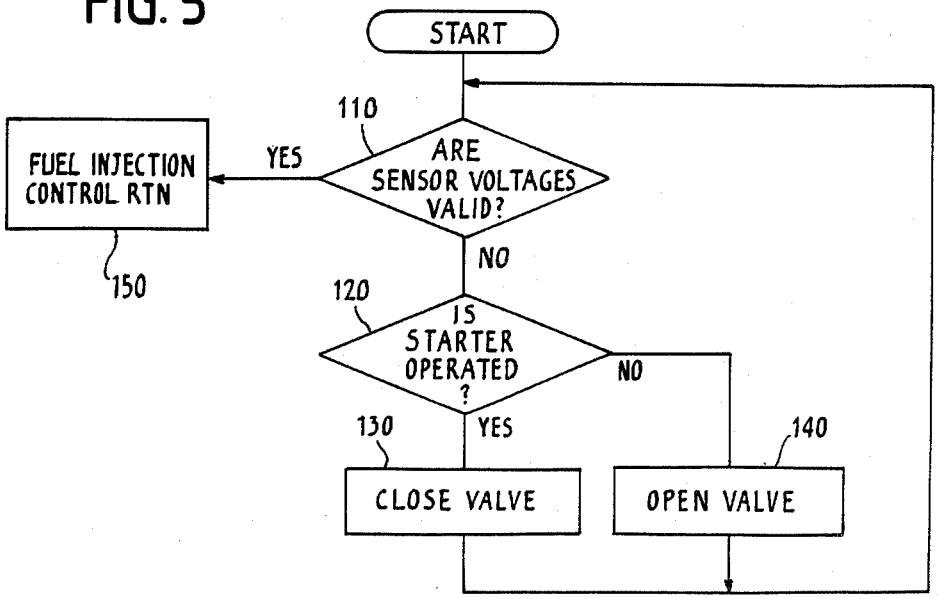
FIG. 5 is a flowchart describing a fuel injection control routine according to the invention.

FIG. 5 is an illustration of a flowchart describing programmed instructions for starting the engine. Decision block 110 is first executed in response to the turn-on of the ignition key to test to see if valid voltage signals are supplied from rotational speed sensor 32 and angular position sensor 36 for a predetermined period of time. If the answer is affirmative, exit is to the normal fuel injection control routine 150.

If the answer is negative in block 110, exit is to block 120 which checks to see if the engine starter switch 42 is operated. If the answer is positive, control exits to operations block 130 which directs the closing of the solenoid valve 26 and causes control to return to block 110. If the answer is negative in block 120, exit is to operations block 140 which directs the opening of the solenoid valve 26 and causes control to return to block 110.

By executing the engine-start fuel injection control routine prior to the execution of the fuel injection routine, fuel is forcibly supplied to the engine to start it in the absence of valid fuel control input parameters from sensors 32 and 36. After the engine has been started, exit from decision 110 is to block 150 which directs the execution of the fuel injection control routine in response to the various engine operating parameters.

What is claimed is:

1. A fuel injection control apparatus for an internal combustion diesel engine which is started by an engine starter, comprising:

engine operating parameter detecting means for detecting operating parameters of said engine, the operating parameter detecting means including an engine speed sensor which generates by electromagnetic induction an engine speed indicating sinusoidal signal having a frequency indicating the speed of said engine when said speed is higher than a predetermined speed value and an amplitude variable as a function of the speed of said engine when said speed is lower than said predetermined speed value and a substantially constant amplitude when the engine speed is higher than said predetermined speed value;

fuel injection quantity of calculating means for calculating the quantity of fuel to be supplied to said engine in accordance with said detected operating parameters of said engine;

engine start detecting means for detecting when said engine starter is being operated and generating an output signal indicating the operation of said engine starter;

verifying means for verifying that said speed indicating signal is valid or invalid depending on whether said amplitude is higher or lower than a predetermined threshold, respectively; and fuel injection control means for effecting the injection of fuel in accordance with the calculated fuel quantity when said speed indicating signal is detected as being valid and forcibly effecting the injection of a fixed amount of fuel when said speed indicating signal is detected as being invalid during the presence of said output signal of said engine start detecting means, said fuel injection control means including a housing having a fuel inlet passage, a fuel relief passage and fuel outlet passages connected respectively to cylinders of said engine, a reciprocating shaft defining a compression chamber at one end thereof with an inner wall of said housing and including a spill port, a delivery port and a passage communicating said compression chamber to said fuel relief passage through said spill port and communicating said compression chamber to each of said fuel outlet passages through said delivery port, said compression chamber being arranged to communicate with said fuel inlet passage when said end of the shaft is in a position away from said inner wall and out of communication therewith when said end is in a position proximate to said inner wall, means for causing said shaft to provide both rotary and reciprocating movements with the rotation of an output shaft of said engine, and a solenoid valve responsive to an output signal from said calculating means when said speed indicating signal is detected as being valid for closing and opening said fuel relief passage and forcibly closing said fuel relief passage when said speed indicating signal is detected as being invalid in the presence of the output signal of said engine start detecting means.

2. A fuel injection control apparatus as claimed in claim 1, wherein said engine operating parameter detecting means includes an angular position sensor which generates by electromagnetic induction an angular position indicating sinusoidal signal at predetermined angular positions of said output shaft of said engine, said angular position indicating signal having an amplitude variable as a function of the engine speed when it is lower than said predetermined speed value and a constant amplitude when the engine speed is higher than said predetermined speed value, further comprising:

means for verifying that said angular position indicating signal is valid or invalid depending on whether the amplitude thereof is higher or lower than said threshold, respectively, said fuel injection control means forcibly effecting the injection of a fixed amount of fuel to said engine when at least one of said speed indicating signal and angular position indicating signal is detected as being invalid in the presence of the output signal of said engine start detecting means.

3. A method for controlling the injection of fuel to an internal combustion diesel engine which is started by an engine starter, comprising the steps of:

(a) electromagnetically generating a speed indicating sinusoidal signal having an amplitude variable as a function of the speed of revolution of said engine when the engine speed is lower than a predetermined speed value and a substantially constant amplitude when said engine speed is higher than said predetermined speed value;

(b) calculating the quantity of fuel to be supplied to said engine as a function of said speed indicating signal;

(c) verifying that said speed indicating signal is valid or invalid depending on whether the amplitude thereof is higher or lower than a predetermined threshold;

(d) detecting whether said engine starter is operating or not;

(e) electromagnetically generating a position indicating signal indicative of the angular position of an output shaft of the engine, said position indicating signal having a variable amplitude as a function of the speed of said engine when it is lower than said predetermined speed value and a constant amplitude when the engine speed is higher than said predetermined speed value;

(f) verifying that said position indicating signal is valid or invalid depending on whether the amplitude thereof is higher or lower than said threshold; and (g) injecting fuel to said engine in accordance with the calculated fuel quantity if said signals are detected as being valid and forcibly injecting a fixed amount of fuel to said engine if at least one of said signals is detected as being invalid in the presence of the output signal of said engine start detecting means.

* * * * *